US006022020A

United States Patent [19]

Nishikawa

[11] Patent Number: 6,022,020

[45] Date of Patent: Feb. 8, 2000

[54] GAME MACHINE WITH AN ENDLESS BELT THAT MOVES OPPOSITE TO A DIRECTION OF MOVEMENT OF A PLAY PIECE

[75] Inventor: Ikuo Nishikawa, Tochigi-ken, Japan

[73] Assignee: Unikiki Co., Ltd., Tochigi-ken, Japan

[21] Appl. No.: 09/105,197

[22] Filed: Jun. 26, 1998

[30] Foreign Application Priority Data

Jul. 10, 1997 [JP] Japan ..... 9-185464
Apr. 17, 1998 [JP] Japan ..... 10-107352

[51] Int. Cl.[7] ..... A63F 7/02

[52] U.S. Cl. ..... 273/108; 273/109; 273/119 R; 273/354; 273/122 R

[58] Field of Search ..... 273/317.7, 354, 273/356, 359, 366, 369, 371, 395, 396, 397, 399, 405, 108, 109, 117, 119 R, 120 R, 121 R, 123 R, 126 R, 129 R, 122 R; 473/FOR 231

[56] References Cited

U.S. PATENT DOCUMENTS 5,257,780 11/1993 Cook et al. .
5,445,376 8/1995 Bromley .
5,667,217 9/1997 Kelly et al. .
5,676,371 10/1997 Kelly et al. .
5,697,617 12/1997 Egging .

*Primary Examiner*—William M. Pierce
*Attorney, Agent, or Firm*—Young & Thompson

[57] ABSTRACT

A game machine in which an endless belt is circularly moved such that an upper face thereof is moved from a background side to a foreground side relative to a player. A target moving in a crosswise direction of the endless belt is provided at an upstream side of the endless belt. A disk shooter provided at a downstream side of the endless belt is operated so as to aim a shooting chute of the disk shooter at the target. A disk is shot from the disk shooter upon pressing a shooting button for activating the disk shooter. The shot disk advances toward the target, rolling on the endless belt. In case the disk hits the target, a score is obtained. The score is added and indicated by a score indicator. The disk having reached the upstream side strikes a stopper plate and falls on the endless belt. The laid disk is conveyed to the downstream side in accordance with the circular movement of the endless belt.

22 Claims, 9 Drawing Sheets

GAME MACHINE WITH AN ENDLESS BELT THAT MOVES OPPOSITE TO A DIRECTION OF MOVEMENT OF A PLAY PIECE

BACKGROUND OF THE INVENTION

1. Field of the Invention

The present invention relates to a game machine in which a disk (including a coin, a token, a medal and so forth) is directly used as a game element.

2. Description of the Related Art

As a game machine in which a coin is used as a game element, a coin pusher game machine (alternatively called a coin fall game machine) is well known. In this game machine, movement of the coin itself affects a game process. Such game machine is different from, for example, a slot machine in which the coins are paid out as a prize when a game is successful.

In the coin pusher game machine, many coins are piled up on a playing board. The coin pushed out from an edge of the playing board by moving a pusher plate, and dropped therefrom is given to a player. The player inserts the coin toward a proper position of the playing board, watching a moving stroke of the pusher plate and a coin piling state on the playing board. When the inserted coin stops so as not to overlap with another coin and is pushed by the pusher plate to a place where a large number of coins are piled up, the player can obtain many coins.

The coin pusher game machine has peculiar interests regarding some points in that movement of the coin is variously changed by an interaction between the coins piled up on the playing board and the coin pushed by the pusher plate, and in that the coin itself which is one of game elements can be obtained as a prize. However, in such game machine, a place where the coin inserted by the player stops is determined by contingency. Moreover, the player can not make a prediction how the coin is pushed by the pusher plate. Thus, there arises a problem in that player's skill is not fully reflected.

Moreover, a game machine in which the coin is used as its game element, more particularly, the coin is shot up to a playing board is also well known. In such game machine, based on a course of the coin dropping on the playing board, a game result is judged and, according to this, a score is given to the player. Also in this case, the game result is more affected by the contingency rather than the player's skill. Accordingly, there arises a problem in that the player loses interest.

SUMMARY OF THE INVENTION

In view of the foregoing, it is a primary object of the present invention to provide a game machine in which a disk having a small diameter is used as a game element, and a game result is affected by not only contingency but also player's skill.

It is a second object of the present invention to provide a game machine in which various interests are given by using a disk having a small diameter as a game element.

It is a third object of the present invention to provide a game machine in which a disk used as a game element can be easily collected.

In order to achieve the above and other objects, the game machine according to the present invention comprises an endless belt which is circularly moved such that an upper face thereof is moved toward a player. At an upstream side of the upper face of the endless belt, a target is provided so as to be movable in a crosswise direction of the endless belt. The target is reciprocated in the crosswise direction of the endless belt. Further, at a downstream side of the upper face of the endless belt, a disk shooter for shooting a disk toward the target is provided.

In a preferred embodiment, the target has a gate through which the disk passes. When the disk passes through the gate, the disk is detected by a photo sensor attached to the target.

On the other hand, the disk shooter is adapted to be rotated by the player. The player rotates the disk shooter, aiming it at the moving target. And then, at a proper timing, the player presses a shooting button to shoot the disk from the disk shooter. By the way, instead of rotating the disk shooter, a translation operation of the disk shooter may be performed by the player.

The disk shot from the disk shooter is forwarded onto the endless belt in a standing position, and rolls thereon toward the target. In case the disk passes through the gate of the target, in other words, the disk hits the target, the disk is detected by the photo sensor. Upon detection of the disk, a prize is awarded for the player.

When the disk falls on its way to the target, the disk strikes a stopper plate provided at an upstream side of the target. After striking the stopper plate, the disk is brought down on the endless belt. All the disks laid on the endless belt are conveyed toward a downstream side to be collected. During the conveyance, the laid disk becomes an obstacle for the succeeding shot disk.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
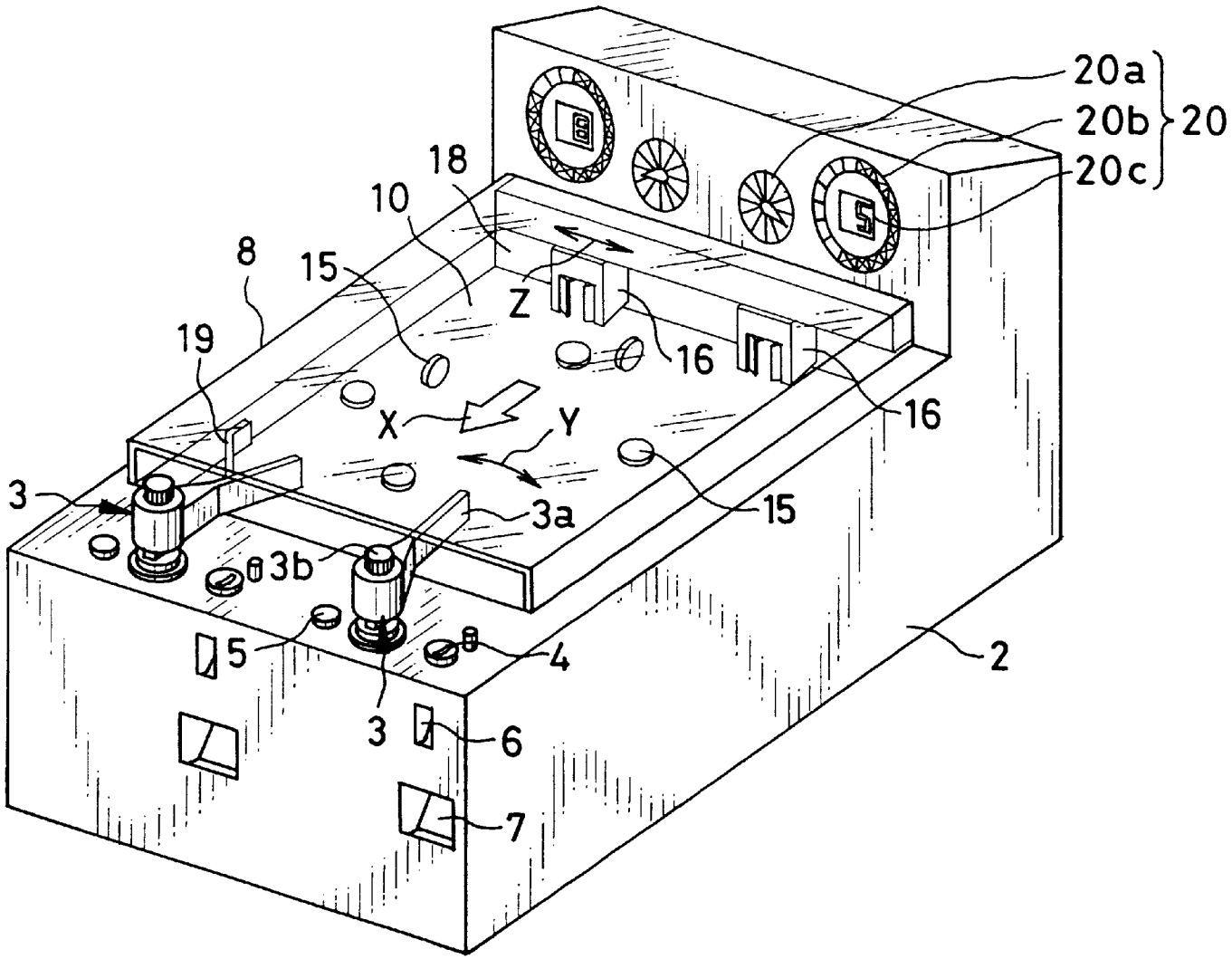
FIG. 1 is a perspective view showing an embodiment of a game machine using a disk according to the present invention.
Figure 2:
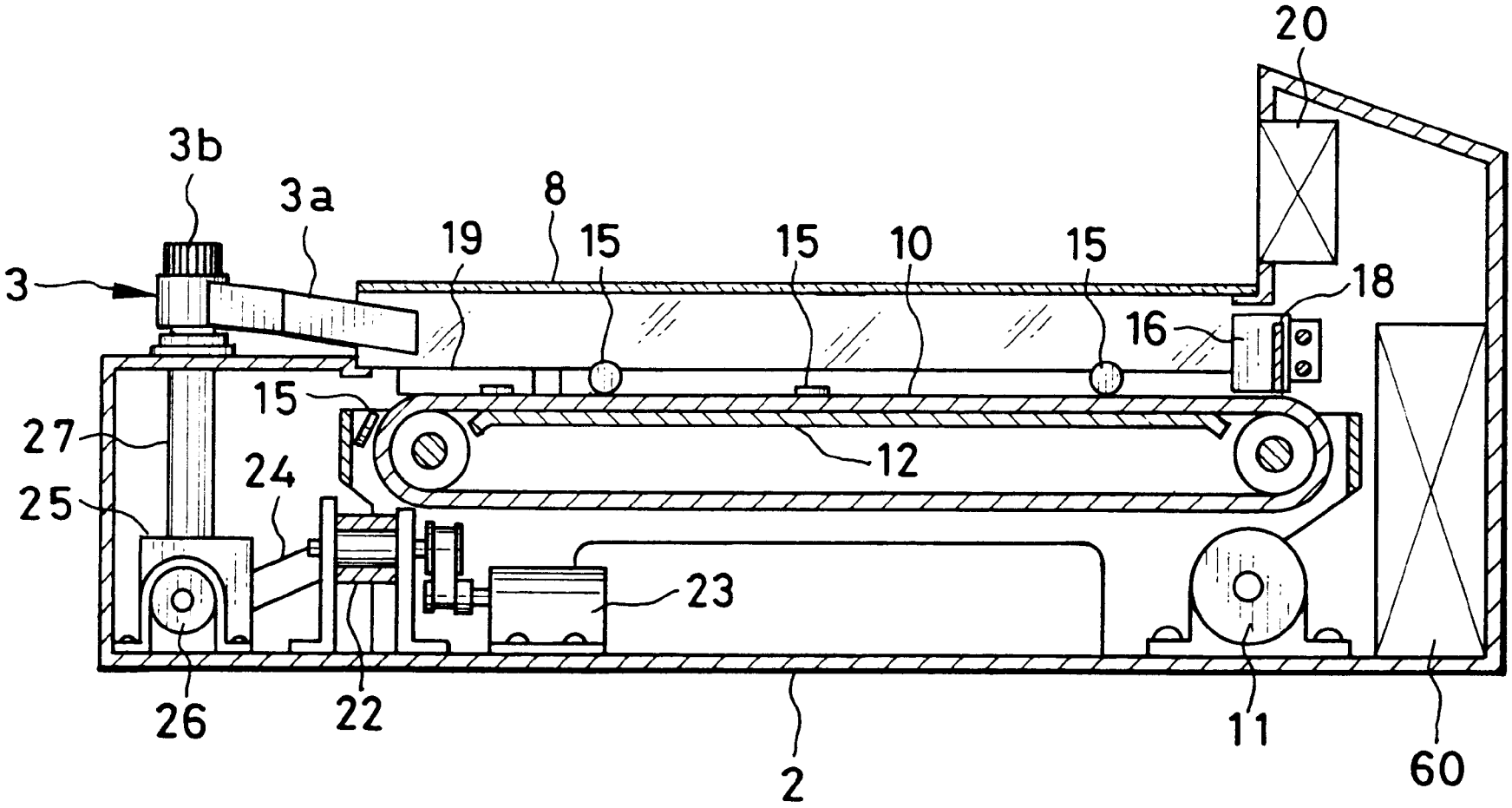
FIG. 2 is a schematic sectional view of the game machine shown in FIG. 1.

FIGS. 1 and 2 respectively show a perspective view and a schematic sectional view of a game machine using a disk according to the present invention. In FIG. 1, a foreground side of a cabinet 2 becomes an operating section and is provided with a disk shooter 3, a coin inlet 4 and a shooting button 5. Reference numeral 6 denotes a coin rejecting port for rejecting an unacceptable coin or a coin excessively inserted. Reference numeral 7 denotes a prize awarding port for discharging a prize which is obtained when a game is successful. In the embodiment shown in FIGS. 1 and 2, since a pair of operating units are provided, two players can play the game at the same time. However, the game may include only one operating unit to play the game alone.

An upper portion of the cabinet 2 is covered with a transparent cover plate 8 so as to be capable of observing an upper face of an endless belt 10 provided in the cabinet 2. The endless belt 10 is driven such that its upper face is moved in a direction represented by an arrow X shown in FIG. 1. The movement of the endless belt 10 is performed by a belt driving motor 11 shown in FIG. 2. In other words, the upper face of the endless belt 10 is moved from a background side to a foreground side relative to FIG. 1. As a material of the endless belt 10, a rubberized material, for example, is used in order to increase the friction of a surface of the endless belt 10. By the way, the upper face of the endless belt 10 is maintained almost horizontally. However, the endless belt 10 may be slightly tilted so as to be lowered or raised toward the background side in FIG. 1. In this embodiment, a supporting plate 12 supports the upper face of the endless belt 10 from an under side thereof to prevent the upper face from curving or becoming a rugged face.

The disk shooter 3 comprises a shooting chute 3*a* whose top tilts downward, and a knob 3*b* fixed to an upper face thereof. The shooting chute 3*a* is rotatable around a vertical axis within a range of a predetermined angle (for example, 30 degrees) which is regulated by a stopper. Accordingly, a direction of the top of the shooting chute 3*a* is changeable. Upon operation of the shooting button 5, a disk 15 rolls through the top of the shooting chute 3*a* in a standing state, and is forwarded onto the endless belt 10. The forwarded disk 15 rolls on the upper face of the endless belt 10 which is moved toward the foreground side, and advances to an upstream side of the endless belt 10.

At the upstream side of the upper face of the endless belt 10, two targets 16 are provided so as to correspond to the pair of the operating units. The target 16 is adapted to reciprocate in a crosswise direction of the endless belt 10. The crosswise direction is represented by an arrow Z in FIG. 1. In this case, since two targets 16 are provided, a moving distance of each target 16 is set in half of a width of the endless belt 10. This moving distance is a range wherein the player can aim the shooting chute 3*a* of the disk shooter 3 at the corresponding target 16. Of course, when the operating unit and the target are respectively provided by one, the target 16 is adapted to be movable throughout the whole width of the endless belt 10.

At the upstream side of the target 16, a stopper plate 18 is provided such as to traverse the endless belt 10. This stopper plate 18 receives the disk 15 rolling on the endless belt 10 in the standing state and having reached the stopper plate. The disk received by the stopper plate 18 is brought down on the endless belt 10. Then, the laid disk 15 is conveyed toward a downstream side in a laying state according to the movement of the endless belt 10. The disk 15 having been conveyed to the downstream side is collected around a central portion of the endless belt 10 by a pair of collecting plates 19 which are provided at both sides of the endless belt 10. The central portion where the disk 15 is collected is located at the downstream side relative to the top of the shooting chute 3*a*.

Two indicating devices 20 are attached to a rear portion of the cabinet 2. The indicating device 20 comprises a time indicator 20*a*, a shot number indicator 20*b* and a score indicator 20*c*. The time indicator 20*a* indicates a passage time after starting the game, and the game is over when one minute, for example, has passed. The shot number indicator 20*b* indicates a number of the disks 15 shot from the disk shooter 3, and the game is over when the sixteen disks, for example, have been spent. The score indicator 20*c* indicates a score obtained when the disk 15 hits the target 16. The score is added and its total amount is indicated by the score indicator 20*c*. As to these indicators 20*a*, 20*b* and 20*c*, it is possible to use a light emitting device of a lamp, an LED or the like, a CRT, a liquid crystal display panel, and so forth.

The disk 15 having been conveyed by the endless belt 10 drops from the endless belt 10 onto a distributing belt 22. The distributing belt 22 distributes the disk 16 in accordance with a driving direction of a motor 23. The disk distributed by the distributing belt 22 is sent, via a conveying chute 24, to a disk advancing device 25 provided under each disk shooter 3. Inside of the disk advancing device 25, a sensor for detecting whether the disks are fully stored or not is provided. The sensor is provided in each disk advancing device 25, and the driving direction of the motor 23 is changed based on signals outputted from the sensors. When the disk advancing device 25 is actuated by a motor 26, the disk 15 is sent to the disk shooter 3 corresponding to the actuated disk advancing device 25 through a first disk guide 27.

Figure 3:
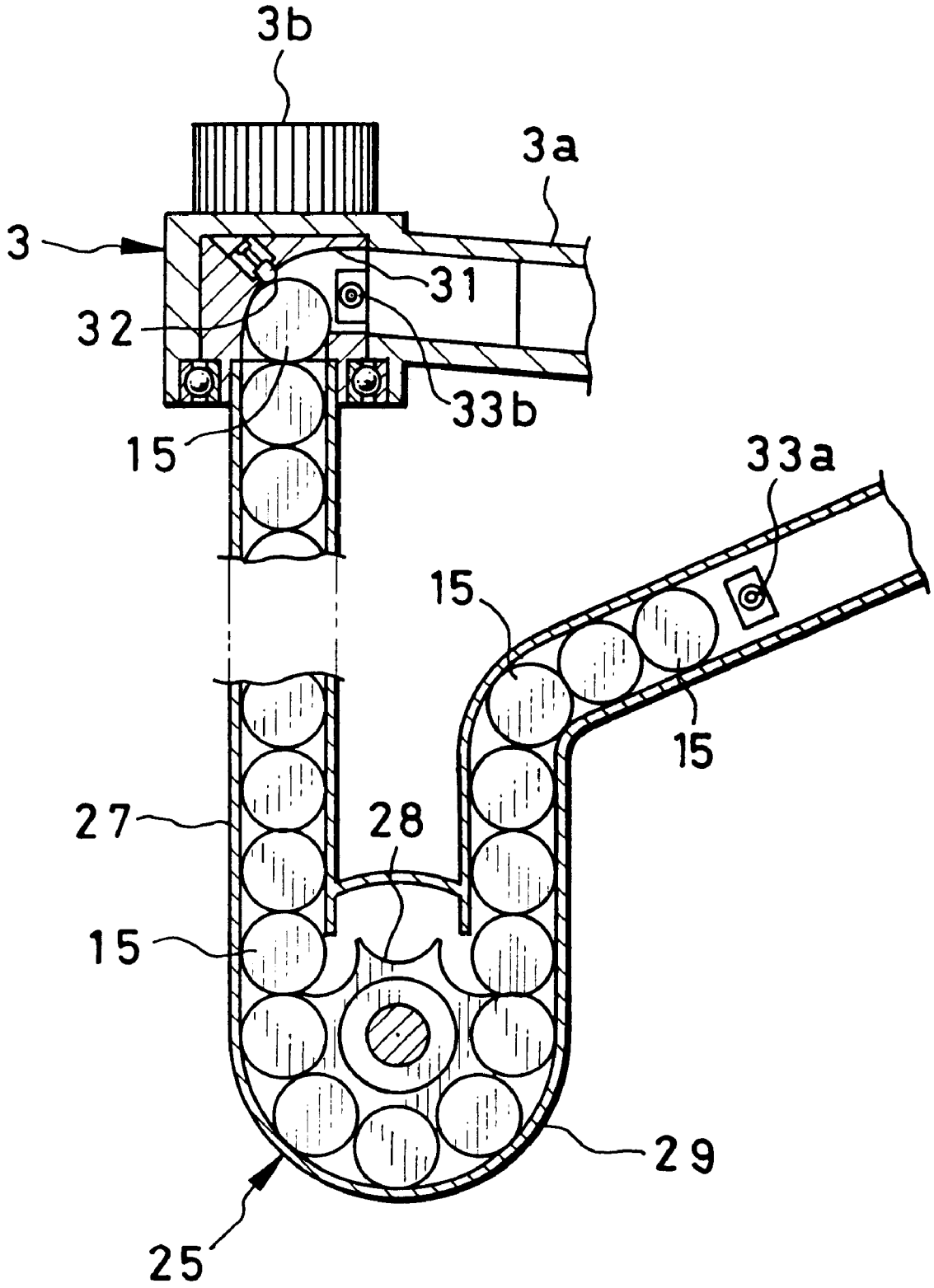
FIG. 3 is a schematic sectional view showing a disk shooter and a disk advancing device.

Structure of the disk advancing device 25 is schematically shown in FIG. 3. The disk advancing device 25 comprises a sprocket wheel 28 and a second disk guide 29. The second disk guide 29 contacts a periphery of the disk 15 and defines a moving passage thereof. One end of the second disk guide 29 is connected to the conveying chute 24, and the other end of which is connected to the first disk guide 27 which is connected to the disk shooter 3. The sprocket wheel 28 is provided with eight teeth. A shape between these teeth coincides with a periphery of the disk 15. The sprocket wheel 28 is rotated every 45 degrees by the motor 26 which is step driven so that the disk 15 is pushed up to the first disk guide 27 one by one.

The disk shooter 3 has a guiding passage 31 for turning the advancing direction of the disk 15 vertically pushed up along the first disk guide 27 to a front direction, namely, a substantially horizontal direction. The shooting chute 3*a* is rotatably attached to the guiding passage 31 such as to be rotatable around a vertical axis. An inside of the root of the shooting chute 3*a* is formed so as to be tapered toward the top of the shooting chute 3*a*. Thus, after the shooting chute 3*a* has been rotated to any position within the range of the predetermined angle, the disk 15 discharged from the guiding passage 31 is forwarded onto the endless belt 10 through the tapered portion of the shooting chute 3*a*.

A click pin 32 urged and projecting toward the inside of the guiding passage 31 is attached to the guiding passage 31. The click pin 32 retains the disk 15 pushed into the guiding passage 31. When the motor 26 is step driven by 45 degrees in accordance with a pressing operation of the shooting button 5, the disk 15 enters the guiding passage 31, pressing the click pin 32. Successively, when the disk 15 has passed the click pin 32, the disk 15 is pushed toward the shooting chute 3*a* by resiliency of a click spring. At the same time, the click-stop operation is performed for the next disk 15 introduced into the guiding passage 31 so that the next disk 15 is not forwarded to the shooting chute 3*a* continuously.

At the upstream side of the second disk guide 29 relative to the sprocket wheel 28, a disk sensor 33*a* of photoelectric type is provided. Further, a similar disk sensor 33*b* is provided at the guiding passage 31. The disk sensor 33*a* is used for detecting whether the stored disks 15 are sufficient or not. When the disk 15 has not been detected by the disk sensor 33*a* as shown in FIG. 3, the driving direction of the motor 23 is changed, and after the disk 15 has been detected by the disk sensor 33*a*, the drive of the motor 23 is stopped. On the other hand, the disk sensor 33*b* detects whether the disk 15 has passed or not just after step driving of the motor 26 caused by the operation of the shooting button 5. At this time, a detection signal outputted from the disk sensor 33*b* is used as a signal for confirming the shooting.

Figure 4:
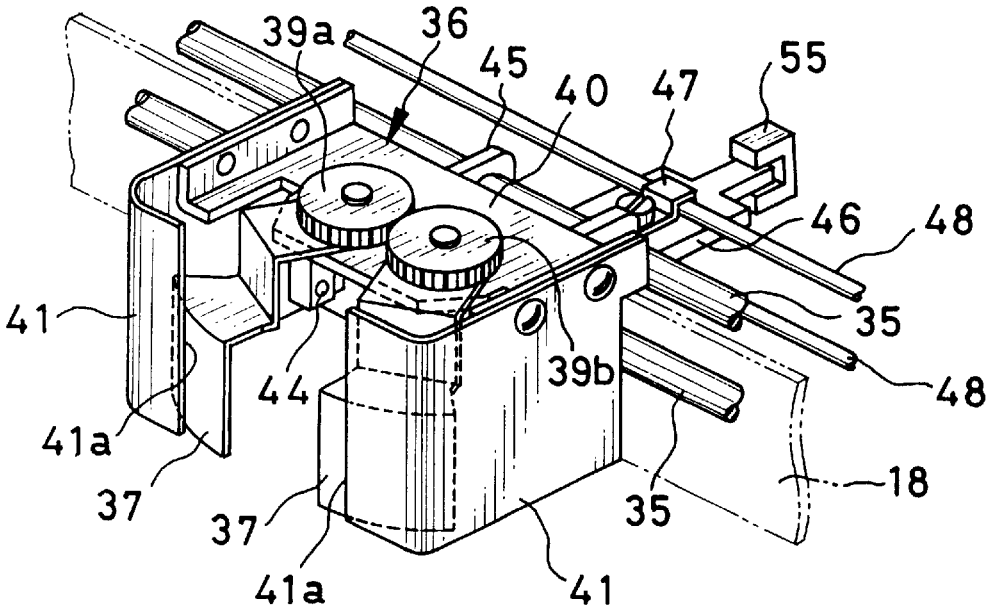
FIG. 4 is a perspective view showing an example of a target employed in the game machine according to the present invention.
Figure 5:
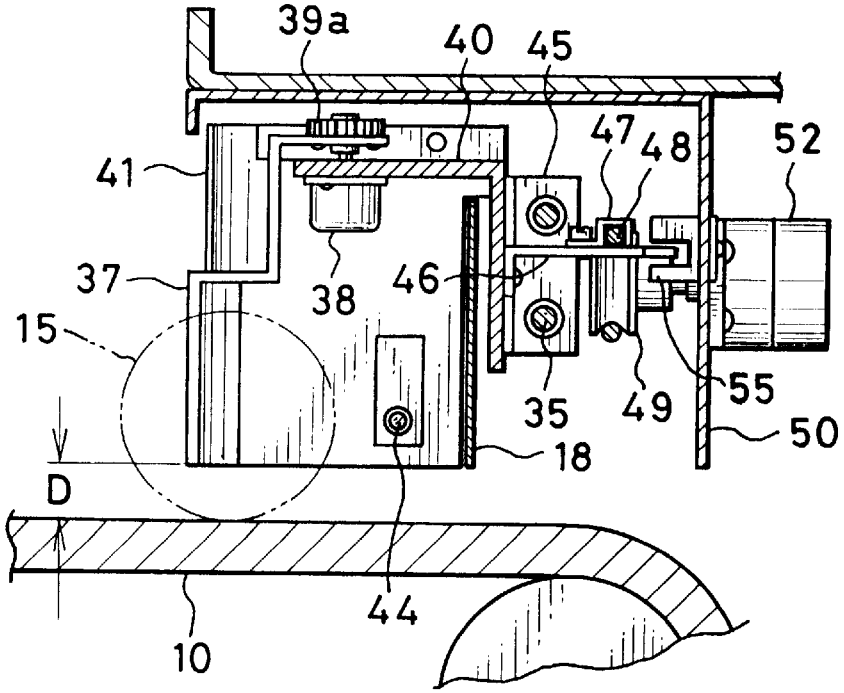
FIG. 5 is a partial sectional view of the target shown in FIG. 4.

Structure of the target 16 is shown in FIGS. 4 and 5. The target 16 comprises a target body 36 and a pair of openable members 37. The target body 36 is supported by a pair of guide rods 35 elongated in the crosswise direction of the endless belt 10. The openable member 37 is rotatably attached to the target body 36. The target body 36 is provided with a bracket 40 and a pair of skirts 41. The bracket 40 has an L-like shape on its cross section. A motor 38 for changing a gate width of the openable members 37 is attached to an inner face of the bracket 40, and a pair of gears 39*a* and 39*b* meshing each other are attached to an outer face of the bracket 40. The skirts 41 are fixed so as to cover an under portion of the bracket 40 from its side to its front. Front edges 41*a* of these skirts 41 form a wide gate in front of the target 16.

A drive shaft of the motor 38 is directly connected with one of the gears 39*a* and 39*b*, in this embodiment, the gear 39*a*. When the motor 38 is driven, the other gears 39*b* is rotated in an opposite direction to the driving direction of the motor 38. In other words, the pair of the openable members 37 are respectively rotated in the opposite directions. In this condition, the motor 38 is driven in an order direction or a reverse direction at a predetermined cycle, thereby, the openable members 37 set the gate width thereof in a wide state or in a narrow state behind the gate formed by the pair of the skirts 41. By adjusting the gate width of the openable members 37, difficulty in hitting the target is adjusted. In this way, gate width changing means for adjusting the difficulty is constructed.

A photo interrupter is attached to an inner face of the skirt 41. The photo interrupter photoelectrically detects the disk 15 having entered the target body 36 through the gate. In FIGS. 4 and 5, only a photo sensor (photo receiver) 44 of the photo interrupter is shown, however, a photo emitter is fixed to an opposite inner wall of the skirt 41. When a space between the photo emitter and the photo receiver is interrupted by the disk 15, a hit signal representing the hit of the target is outputted.

A guide plate 45 through which the pair of the guide rods 35 pass is fixed to a rear bending portion of the bracket 40. Besides the guide plate 45, a driving plate 46 is also fixed to the rear bending portion of the bracket 40. A lock member 47 is securely fixed to an upper face of the driving plate 46 by a screw in order to attach the target body 36 to a rope 48. The rope 48 is elongated in the crosswise direction of the endless belt 10 similarly to the guide rod 35. The rope 48 is set in a loop-like state. Both sides of the rope set in the loop-like state are respectively put on pulleys 49. The pulley 49 is rotatably attached to a rear board 50 fixed to the cabinet 2, and is driven by a motor 52 fixed to the rear board 50.

The two targets 16 are supported by the common guide rods 35, however, the rope 48 and the motor 52 are respectively provided for each of the targets 16. Each target 16 is individually movable within a range of about a half width of the endless belt 10. The target 16 is detected at both ends of its moving range by a photo interrupter 55 fixed to the rear board 50. A detection signal of the target 16 is used as a signal for changing the driving direction of the motor 52. Accordingly, the target 16 is repeatedly reciprocated within the half width of the endless belt 10.

The stopper plate 18 is disposed between a rear end of the skirt 41 and the rear bending portion of the bracket 40. The stopper plate 18 stops the advancement of the disk 15 having rolled thereto regardless of passing through the gate, and brings down the disk 15 on the endless belt 10. A gap D which is wider than the thickness of the disk 15 is set between the bottom of the target 16 and the upper face of the endless belt 10 so as not to disturb the movement of the target 16 with the disk 15 having struck the stopper plate 18 and brought down on the endless belt 10.

A control circuit unit 60 including a micro computer controls each of the belt driving motor 11 used as an actuator in the above-described game machine, the motor 23 for driving the distributing belt 22, the motor 26 for shooting the disk 15, the motor 38 for changing the gate width of the openable members 37, the motor 52 for moving the target 16, a coin sensor disposed behind the coin inlet 4, the indicating device 20, and the sensors including the disk sensors 33*a* and 33*b*, the photo sensor 44, the photo interrupter 55 for detecting the position of the target 16, and so forth.

Figure 6:
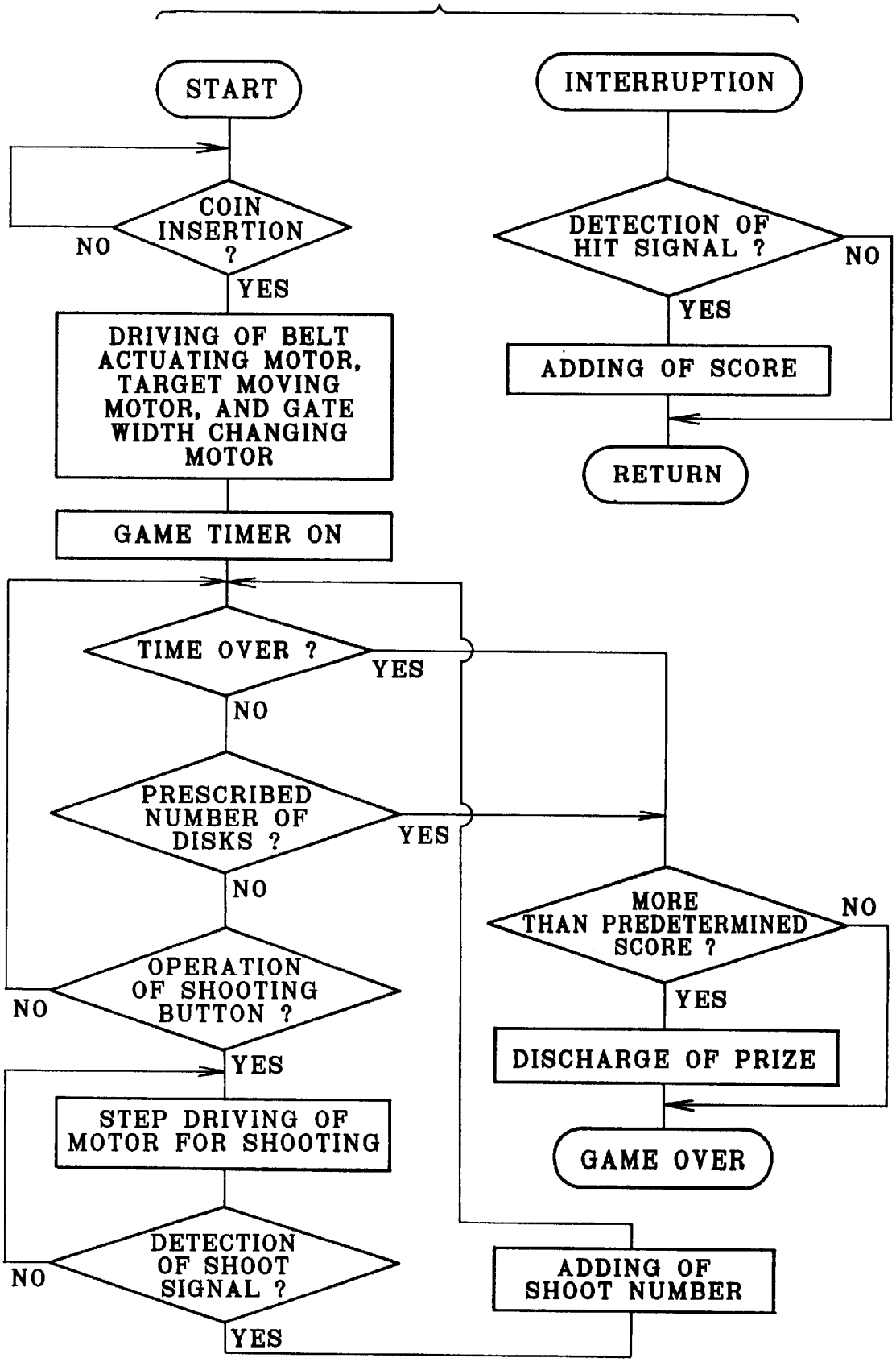
FIG. 6 is a flow chart showing a game process of the game machine according to the present invention.

Hereinafter, referring to a flow chart shown in FIG. 6, an operation of the above game machine is described. When the coin inserted into the coin inlet 4 is judged as a proper coin by the coin sensor disposed behind the coin inlet 4, the belt driving motor 11, the gate width changing motor 38 and the target moving motor 52 are started at the same time. Thereby, the endless belt 10 begins the circular movement from the background side to the foreground side relative to the player. Further, the target 16 corresponding to the coin inserted side is repeatedly reciprocated in the crosswise direction of the endless belt 10, changing the gate width thereof. At time that such working is started, a game timer starts to count the time.

After the game has been started in this way, the player can shoot the disk 15 at any timing, aiming the target 16 on condition that a predetermined game period, for example, one minute set by the game timer has not passed, and the disks of a described number relative to one game, for example, sixteen disks have not been consumed. The subject of the present game is to hit the target 16 with the disk 15 during the game period and within the predetermined number of disks, and the prize is awarded when, for example, ten or more hits are obtained.

The player aims the shooting chute 3*a* at the target 16 in synchronism with its movement by using the knob 3*b*. Successively, the player observes the movement of the openable members 37 and presses the shooting button 5 at a timely moment, that is, when the gate width of the openable members 37 is most widened. The motor 26 for shooting the disk is step driven every 45 degrees so that the disk 15 is pushed out from the guide passage 31. The disk 15 rolls inside the shooting chute 3*a* and is forwarded onto the endless belt 10. When the disk 15 is properly shot, the disk sensor 33*b* detects the momentary passage of the disk 15. Based on the detection signal from the disk sensor 33*b*, the shooting of the disk 15 is detected and the shot disk 15 is counted by the counter for adding up the shooting number.

The disk 15 shot from the disk shooter 3 advances toward the upstream side of the endless belt 10, rolling thereon. As the upper face of the endless belt 10 is moved toward the foreground side, the apparent advancing speed of the disk 15 becomes slow. When the target 16 is correctly aimed, the disk 15 reaches the inside of the target body 36 through the gate of the target 16, and the entrance of the disk 15 is detected by the photo interrupter attached to the inner wall of the skirt 41. The detection signal from this photo interrupter is counted as the hit signal.

The disk 15 having hit the target 16 strikes the stopper plate 18 in the target body 36, and is brought down on the endless belt 10. Similarly, the disk 15 having missed the target 16 also strikes the stopper plate 18 to be brought down. These disks 15 are conveyed to the foreground side according to the movement of the endless belt 10. During the conveyance of the disk, the disk 15 laid on the endless belt 10 becomes an obstacle for the succeeding shot disk 15 so that variations are given to the game content.

By the way, if the next disk 15 is shot after the disks 15 laid on the endless belt 10 have been completely conveyed to the downstream side, it becomes easy to aim the target 16. However, since the waiting period is included in the game period, it is likely that the game is over before the disks of permitted shooting number per one game, for example, the sixteen disks are consumed. On the other hand, when the disk 15 is shot in disregard of the disk laid on the endless belt 10, although the shot disk 15 sometimes gets over the laid disk and advances toward the upstream side, most of the disks are brought down, or swerve from a course aimed by the shooting chute 3*a*. Further, if the shooting chute 3*a* is swung when the disk 15 runs out from the top of the shooting chute 3*a*, the rolling of the disk 15 becomes unstable so that its advancing course may be curved, or the disk 15 may fall on its way to the stopper plate 18. As stated above, the game according to the present invention has a great deal of variety as a shooting game.

While the game is played, the game time, the number of the shot disks, and the score are indicated by the time indicator 20*a*, the shot number indicator 20*b*, and the score indicator 20*c* respectively. When the game time has passed or the number of the shot disks has reached the prescribed number of one game, the score obtained until that time is verified. In case the obtained score is equal to or more than a predetermined score, the prize is discharged to the prize awarding port 7, and the game is over.

In the foregoing, the game machine according to the present invention is described based on the embodiment illustrated in the accompanying drawings. However, the present invention is not exclusive to this embodiment. It is possible to perform various modifications and applications. For example, regarding the structure of the disk shooter 3, as used in the conventional coin pusher game machine, the disk may be inserted into an inlet by the player one by one, and forwarded onto the endless belt 10. In this case, a predetermined number of disks may be exchanged and rented out when the coin is inserted into the coin inlet 4.

Moreover, a flexible collection pipe or the like may be connected to the rear side of the target 16. In this case, the disk having hit the target 16 is collected from the rear side of the target 16 without being conveyed by the endless belt 10. By the way, a cycle of the openable members 37 is shifted relative to the moving cycle of the target 16 so that the gate width of the openable members 37 does not correspond to the position of the target 16. However, if the gate width is varied in accordance with the position of the target 16, the openable members 37 may be mechanically actuated in association with the target 16 by using, for example, a cam. In this case, it is possible to remove the gate width changing motor 38.

Figure 7:
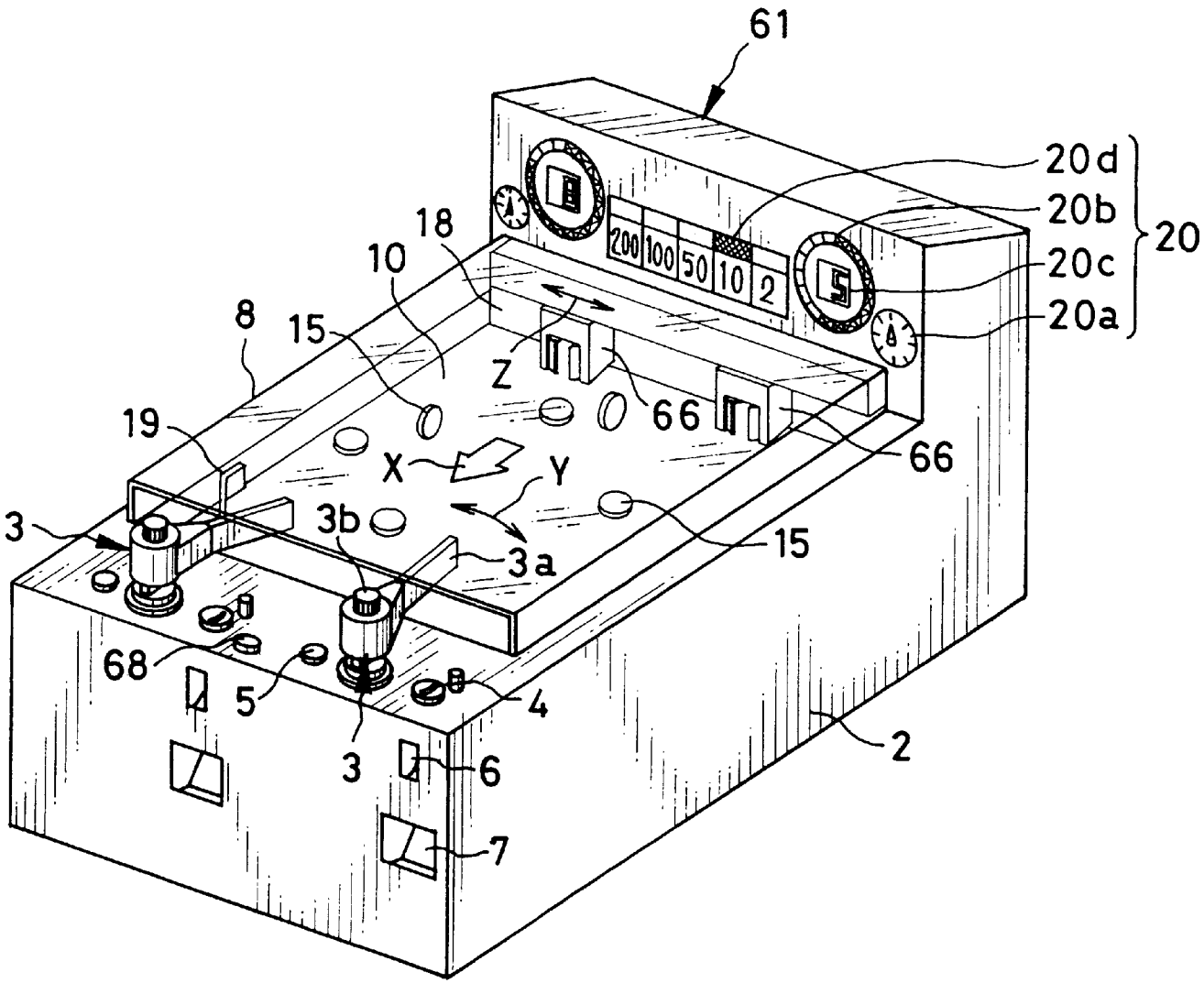
FIG. 7 is a perspective view showing a second embodiment of the game machine according to the present invention.
Figure 8:
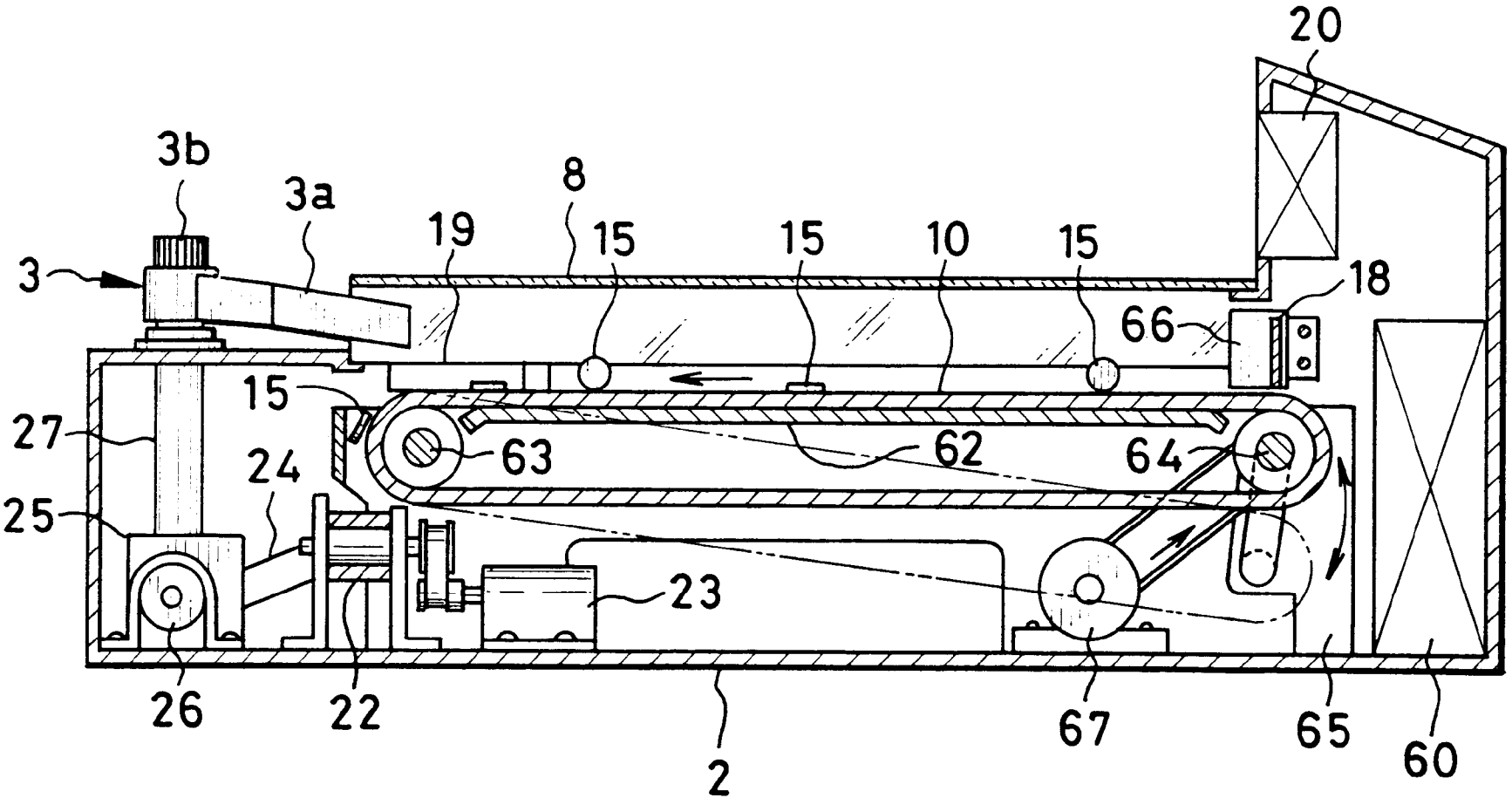
FIG. 8 is a schematic sectional view of the game machine shown in FIG. 7.

Next, a second embodiment of the game machine according to the present invention is described below. FIG. 7 is a perspective view showing the game machine according to the second embodiment, and FIG. 8 is a sectional view thereof. In the game machine 61, a second rotary shaft 64 positioned at the upstream side of the upper face of the endless belt 62 is moved in an up-and-down direction by a belt tilting device 65 for changing an angle of the endless belt 62. In other words, the second rotary shaft 64 is swung centered on a first rotary shaft 63 positioned at the downstream side of the upper face of the endless belt 62. Thus, the endless belt 62 is adapted to be tilted upward or downward from the horizontal state. The belt tilting device 65 rotatably supports the second rotary shaft 64 of the endless belt 62, and irregularly moves the second rotary shaft 64 in the up-and-down direction to vary a slope of the endless belt 62 while the game is played. On the other hand, a target 66 is also moved in the up-and-down direction together with the second rotary shaft 64 of the endless belt 62.

As to the motor 67 for rotating the endless belt 62, its number of revolution is irregularly changed while the game is played so that the moving speed of the endless belt 62 is varied. On the other hand, a prize rate indicator 20*d* is provided between the two shot number indicators 20*b* of the indicating device 20 located at the rear side of the cabinet 2. The prize rate indicator 20*d* indicates a designated rate regarding the number of disks paid out as the prize when the disk 15 hits the target 16.

The game machine according to this embodiment is adapted such that the player can select the game difficulty in advance. For example, if the number of disks paid out upon hitting the target 66 is set at double, the gate width of the target 66 is opened most widely so that hitting probability of the disk 15 is raised and the game difficulty becomes comparatively easy. Alternatively, if the number of disks paid out upon hitting the target 66 is set at fifty times, for example, the gate width of the target 66 is narrowed so as to become a half of the gate width set at time of double. Accordingly, the game difficulty increases in some degree. Further, if the number of disks paid out upon hitting the target 66 is set at two hundred times, for example, the gate width of the target 66 is narrowed so as to coincide with a thickness of two disks 15. In this case, the game difficulty is extremely increased.

The game machine 61 has similar structure to that of the first embodiment except the above-stated structure. Thus, a description regarding a portion of the similar structure is omitted. Moreover, a part being similar to that of the first embodiment is denoted by a same reference numeral.

Hereinafter, an operation of the game machine according to the second embodiment is described. When the coin or the disk paid out as the prize is inserted into the coin inlet 4, the prize rate indicator 20*d* is blinked. The player operates a prize rate selecting button 68 constituting a paid-out number selecting means, and designates the desired rate. Upon selecting the rate, the selected rate of the prize rate indicator 20*d* is turned on. Then, the gate width of the target 66 is changed to the width corresponding to the selected rate. Accordingly, the hitting probability of the disk 15 for the target 66 is varied and the corresponding game difficulty is set.

The endless belt 62 starts to move circularly from the background side to the foreground side relative to the player. As to this endless belt 62, its circulating speed is irregularly changed during the game. Moreover, the belt tilting device 65 irregularly moves the second rotary shaft 64 in the up-and-down direction so that the endless belt 62 is irregularly tilted upward or downward from the horizontal state. When this operation is started, the game timer start to measure the time.

After starting the game in this way, the player can shoot the disk 15 at any timing, aiming the target 66 on condition that the predetermined game period (for example, one minute) set by the game timer has not passed and the disks of the predetermined number (for example, sixteen disks) have not consumed.

When the player presses the shooting button 5 at the proper timing after determining the direction of the shooting chute 3*a* by using the knob 3*b*, the disk 15 is shot from the shooting chute 3*a* onto the endless belt 10 in rolling state. And then, the disk 15 advances toward the upstream side of the endless belt 10, rolling thereon. However, the endless belt 10 moves toward the foreground side relative to the player and its moving speed is irregularly changed. Further, the endless belt 10 is irregularly tilted upward or downward from the horizontal state by the belt tilting device 65. Therefore, the moving speed of the disk 15 is irregularly and complicatedly changed so that it is difficult to predict the moving speed of the disk 15.

Thus, the disk 15 has hardly hit the target 66 only by aiming it, moving the shooting chute 3*a* in synchronism with the movement of the target 66. But, on the other hand, the disk 15 sometimes hits the target 66 by chance. In such way, amusement of the game is raised owing to a combination of the chance and the inevitability so that the interest thereof is greatly increased.

After the disk 15 has hit the target 66, the disk 15 is brought down on the endless belt 10. Moreover, the disk 15 having missed the target 66 is similarly brought down on the endless belt 10 by striking the stopper plate 18. And then, the laid disks 15 are conveyed to the foreground side in accordance with the movement of the endless belt 10. For the succeeding shot disk 15, the disk 15 laid on the endless belt 10 becomes an obstacle, and in this state, the above described changes regarding the speed and the tilt of the endless belt 10 are appended. Accordingly, various changes are added to the game.

After the game period has passed or the number of shot disks has reached the predetermined number, the hit number of the target is checked. If the hit number is three, for example, and the rate of two times is selected before starting the game, the six (two times three) disks are discharged to the prize awarding port 7 as the prize. If the rate of one hundred times is selected, the three hundred (one hundred times three) disks are discharged. The disk discharged as the prize may be used for the next game instead of the coin. Alternatively, when the discharged disks are collected by a predetermined number, these disks may be exchanged for a prize article or the like.

In the above described embodiment, if the speed and the tilt of the endless belt can be controlled by the player during the game, the player's skill may be more reflected to the game. By the way, the speed and the tilt of the endless belt may be regularly changed. In this case, it becomes possible to predict the movement of the disk to some degree.

Figure 9:
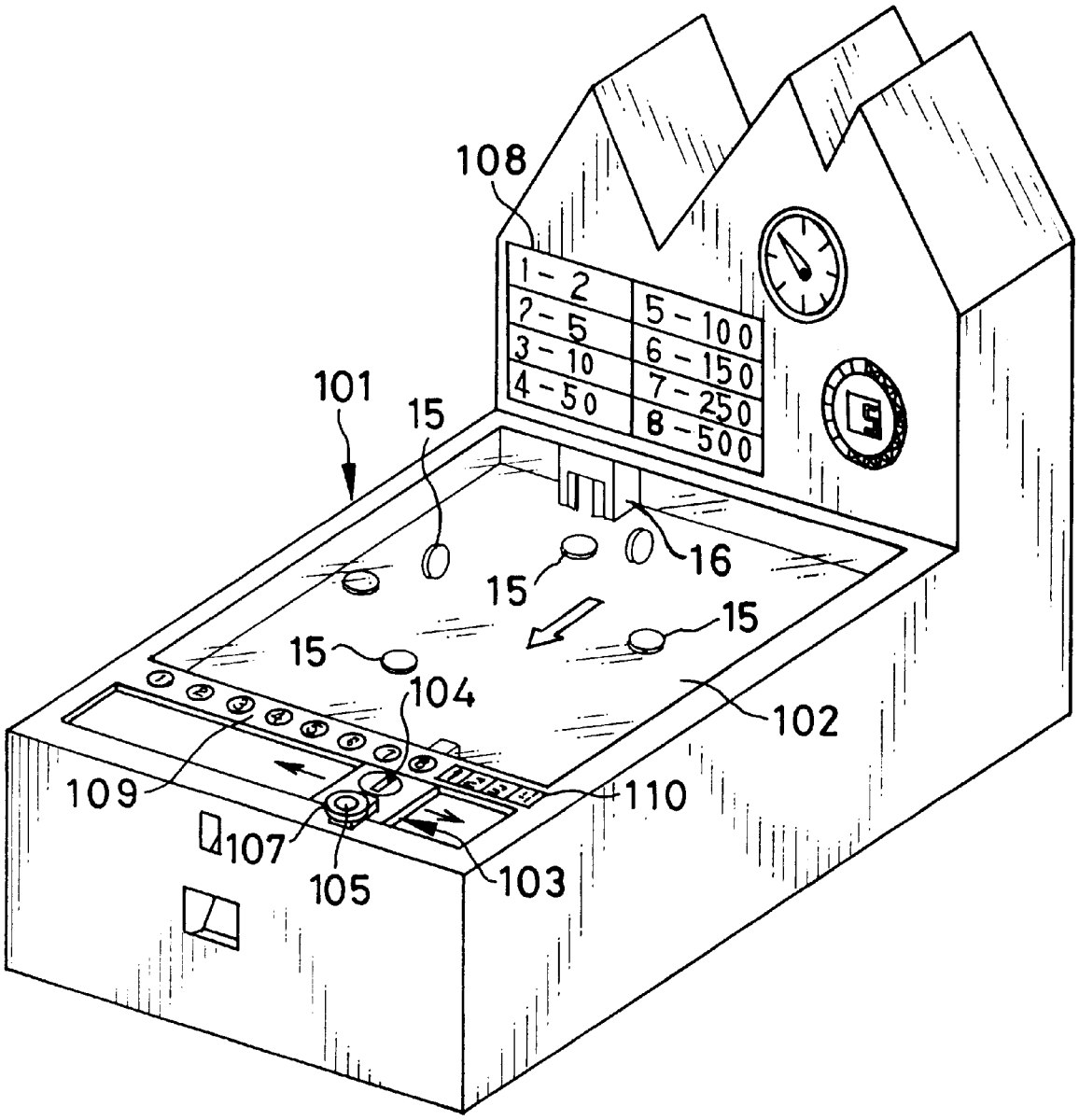
FIG. 9 is a perspective view showing a third embodiment of the game machine according to the present invention.
Figure 10:
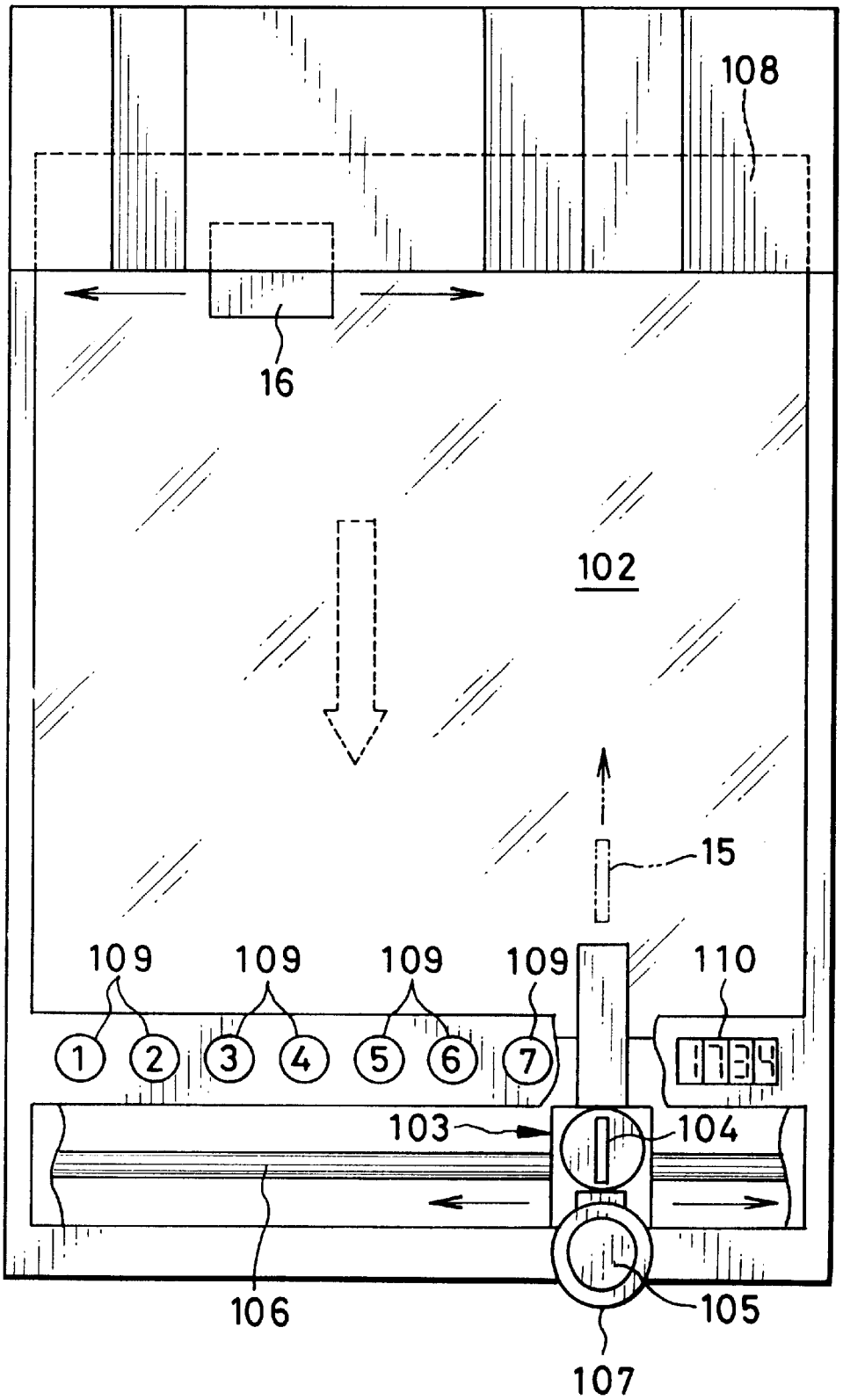
FIG. 10 is a partially cutaway view in plan elevation of the game machine shown in FIG. 9.

Next, a third embodiment of the game machine according to the present invention is described below. FIG. 9 is a perspective view showing the game machine of the third embodiment. FIG. 10 is a partially sectional illustration of the game machine viewed from its top. In the game machine 101, a disk shooter 103 for shooting the disk 15 onto an endless belt 102 is constituted of a disk inlet 104, a disk shooting mechanism (not shown), a shooting button 105 and a grip 107. The disk shooting mechanism stores a plurality of the disks 15, and shoots the disk one by one. The shooting button 105 is for causing the disk shooting mechanism to shoot the disk 15. The grip 107 is for moving the whole of the disk shooter 103 along a rail 106 so as to perform translation operation of the disk shooter 103.

Further, in this embodiment, a display unit 108, first through eighth selection buttons 109 and an obtained disk indicator 110 are provided. The display unit 108 displays the disk numbers paid out when the disk 15 has hit the target 16. The selection buttons 109 correspond to the disk numbers displayed in the display unit 108 one by one. The obtained disk indicator 110 indicates a number of disks being payable at any time after hitting the target 16. Except these parts, the structures of the target 16, the endless belt 102 and so forth are similar to those of the foregoing embodiment.

Hereinafter, an operation of the game machine of the third embodiment is described. The player inserts the disk 15 into the disk inlet 104 of the disk shooter 103 by a predetermined number. In this case, the disk 15 is exchanged with the coin in advance. When the disks of the predetermined number are inserted into the disk inlet 104, the first through eighth selection buttons 109 are blinked. These selection buttons 109 constitute a means for selecting the paid-out disk number. The player presses one of the selection buttons 109 corresponding to the paid-out disk number which is displayed in the display unit 108 and hoped by the player. After the paid-out disk number has been selected, the gate width of the target 16 is changed to the width corresponding to the paid-out disk number selected by the player. Thus, the hitting probability of the disk 15 for the target 16 is changed. The difficulty of the game can be set in this way.

If any of the selection buttons 109 is not operated for a predetermined period after the player has inserted the disk, the paid-out disk number becomes variable and the gate width of the target 16 is continually changed during the game. In this case, when the disk 15 has hit the target 16, the disks are paid out by the number corresponding to the gate width of the target 16 which has been set at time of hitting.

The player operates the grip 107 to move the disk shooter 103 such that the translation operation thereof is performed along the rail 106 and in the crosswise direction of the endless belt 102. Successively, the player presses the shooting button 105 provided at a center of the grip 107 timely. Then, the disk 15 is shot from the disk shooter 103 onto the endless belt 102 in the rolling state.

In this case, as stated above, the disk shooter 103 is moved so as to perform the translation operation in the crosswise direction of the endless belt 102. Accordingly, the angle of the disk shooter 103 does not change. Thus, the disk 15 is always shot on a parallel with the moving direction of the endless belt 102. As a consequence of this, the shot disk 15 runs on the endless belt 102 stably so that the disks falling on its way may be reduced, thereby, fun of the game is greatly increased.

When the disk 15 hits the target 16, the disks of the number selected at beginning of the game are obtained as the prize, and this disk number is indicated by the obtained disk indicator 110. The disks of the indicated number are payable at any time. On the other hand, in case the player plays the game without operating the selection button 109, when the disk 15 hits the target 16, the disks of which number corresponds to the gate width of the target 16 are paid out.

At this time, the gate width of the target 16 is that of the moment when the disk 15 hits the target 16. The disks 15 discharged as the prize may be used for the next game. Alternatively, the disks 15 may be exchanged with the prize article when the disks 15 are collected by a predetermined number.

As described above, in the game machine according to the present invention, the endless belt is circularly moved toward the player, and the target moving in the crosswise direction of the endless belt is provided at the upstream side thereof. The player aims the target and forwards the disk thereto in standing and rolling state. Since the upper face of the endless belt is moved in a reverse direction relative to the advancing direction of the disk, the advancing speed of the disk is slowed down. Moreover, the rolling of the disk is stably continued, thus, it is possible to provide the shooting game machine having great interest.

As the stopper plate is provided at the upstream side of the target, the disk coming to the stopper plate strikes it and falls on the endless belt. The brought-down disk is conveyed to the downstream side in accordance with the movement of the endless belt. While the disk is conveyed to the downstream side, it becomes the obstacle for the next shot disk. Therefore, the variations are given to the game. At the same time, collection of the disk becomes easy. When the gate through which the disk passes is used as the target, it is possible to vary the game difficulty by changing the width of the gate. This is effective for further increasing the game interest.

By changing the speed and the tilt of the endless belt during the game, the contingency of the game is raised, and the interest of the game is further increased. In case the gate width is selectable in advance, it is possible to vary the difficulty of the game.

In the above-described embodiment, as the sensor for detecting the disk having hit the target, the photo sensor is used. However, besides the photo sensor, a micro switch, a magnetic sensor and so forth may be used.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A game machine, comprising:

a housing having an operator end and a target end;

an endless belt in said housing, said endless belt having an upper surface that moves continuously in a direction from said target end toward said operator end, an exposed portion of said upper surface of said endless belt defining a playing area for a game played on the game machine;

a backstop that defines an end of said playing area at said target end, said backstop comprising a wall that overlies and is immediately adjacent to said upper surface of said endless belt across an entire width of said playing area;

a target at said target end that is immediately adjacent to said upper surface, said target comprising a gate that opens a passageway to said backstop, that overlies said playing area and that is farther from said target end than said backstop, and a sensor that senses passage of a play piece on said upper surface through said passageway;

a play piece shooter at said operator end, said shooter comprising a movable chute that overlies and slopes down toward said playing area; and a play piece collector bin adjacent said endless belt at said operator end that defines an end of said playing area at said operator end.

2. The game machine of claim 1, wherein said chute has a rectangular cross-section with a longitudinal axis perpendicular to said upper surface.

3. The game machine of claim 2, further comprising a disk-shaped playing piece having a cross-section corresponding to said rectangular cross section of said chute.

4. The game machine of claim 1, wherein said shooter further comprises a pivoting support for said chute.

5. The game machine of claim 1, wherein said shooter further comprises a lateral support for said chute that extends across the end of the playing area at said operator end and movably carries said chute.

6. The game machine of claim 1, wherein said gate comprises two doors that are movable in a direction parallel to said upper surface to selectively define a rectangular opening with a longitudinal axis perpendicular to said upper surface and whose bottom is said upper surface.

7. The game machine of claim 1, wherein said target further comprises a track that extends across the end of the playing area at said target end and movably carries said gate and said sensor.

8. The game machine according to claim 1, wherein said sensor is a photo sensor.

9. The game machine according to claim 1, wherein said shooter comprises a shooting button that causes ejection of a play piece from said chute when said shooting button is operated.

10. The game machine according to claim 1, comprising two of said targets.

11. The game machine according to claim 10, comprising two of said shooters.

12. The game machine according to claim 1, wherein said target further comprises gate width changing means for changing an open width of said gate.

13. The game machine according to claim 12, further comprising:

prize discharging means for discharging a prize whose value is changed in accordance with said open width of said gate.

14. The game machine according to claim 13, further comprising:

prize value selecting means for selecting the value of the prize, said open width of said gate being changed in accordance with the value of the prize selected by said prize value selecting means.

15. The game machine according to claim 1, further comprising:

belt angle changing means for changing a tilt of said endless belt.

16. The game machine according to claim 15, wherein said belt angle changing means moves one end of said endless belt in an up-and-down direction.

17. The game machine according to claim 16, wherein said belt angle changing means changes said tilt of said endless belt irregularly.

18. The game machine according to claim 1, further comprising:

belt speed changing means for changing a moving speed of said endless belt.

19. The game machine according to claim 18, wherein said belt speed changing means includes a motor for circularly moving said endless belt, said moving speed of said endless belt being changed by controlling an operation of said motor.

20. The game machine according to claim 19, wherein said motor changes said moving speed of said endless belt irregularly.

21. The game machine according to claim 1, further comprising a supplying device for supplying play pieces from said collector bin to said shooter.

22. The game machine according to claim 1, further comprising:

a supporting for supporting said upper surface of said endless belt.

* * * * *